US012369658B1

(12) United States Patent
Gordon

(10) Patent No.: US 12,369,658 B1
(45) Date of Patent: Jul. 29, 2025

(54) SHARK GUARD

(71) Applicant: Zackery Gordon, Roanoke, WA (US)

(72) Inventor: Zackery Gordon, Roanoke, WA (US)

( * ) Notice: Subject to any disclaimer, the term of this patent is extended or adjusted under 35 U.S.C. 154(b) by 0 days.

(21) Appl. No.: 18/956,227

(22) Filed: Nov. 22, 2024

(51) Int. Cl.
*A41D 27/12* (2006.01)

(52) U.S. Cl.
CPC ..... *A41D 27/12* (2013.01)

(58) Field of Classification Search
CPC ..... A41D 27/12
See application file for complete search history.

(56) References Cited

U.S. PATENT DOCUMENTS

| | | | | |
|---|---|---|---|---|
| 3,889,039 | A | 6/1975 | Wainer | |
| 5,720,046 | A * | 2/1998 | Lopez | A43B 1/0054 2/160 |
| 5,950,239 | A * | 9/1999 | Lopez | A42B 1/24 2/113 |
| 6,763,525 | B1 * | 7/2004 | Spector | A61H 39/04 601/134 |
| 9,694,881 | B1 | 7/2017 | Ellis | |
| 9,939,545 | B2 | 4/2018 | Herrara et al. | |
| 10,585,166 | B2 | 3/2020 | Hautson | |
| 10,617,158 | B2 | 4/2020 | Pacheco et al. | |
| 10,729,191 | B2 | 8/2020 | DeLise | |
| 11,076,590 | B2 | 8/2021 | Watson | |
| 2004/0173484 | A1 | 9/2004 | Bates et al. | |
| 2005/0101828 | A1 * | 5/2005 | Butler | A61N 2/06 600/15 |
| 2006/0030879 | A1 * | 2/2006 | Spector | A61H 39/04 606/204 |
| 2015/0297909 | A1 * | 10/2015 | Peashock | A61F 7/02 600/15 |
| 2017/0196276 | A1 | 7/2017 | Park | |

FOREIGN PATENT DOCUMENTS

| | | |
|---|---|---|
| WO | 2016/064409 | 4/2016 |

OTHER PUBLICATIONS

Sharkbanz Amazon Store; Sharkbanz 2 Magnetic Shark Deterrent Band for Swimming, Surfing, Diving, Snorkeling and All Ocean Sports; https://www.amazon.com/Sharkbanz-Magnetic-Shark-Repellent-Band/dp/B01MRS18JM?source=ps-sl-shoppingads-Ipcontext &ref _=bing_fplfs&psc=1; printed Dec. 4, 2024.

* cited by examiner

*Primary Examiner* — Gloria M Hale

(57) ABSTRACT

A device and method of deterring sharks by aligning the poles of each magnet of a plurality of magnets oriented with their magnetic North and South poles on an axis parallel to the top/bottom of an article of manufacture such as a swimsuit, life jacket, surfboard, lifeboat, inner tube and/or scuba suit. In this device and method each magnet is permanently fixed within an individual pouch contained in a fabric or covering to maintain the alignment of the magnetic poles. Each pouch may retain a single magnet or a plurality of magnets within individual cells in a subdivided grid located within the pouch. Aligning the plurality of magnets such that the magnets' North poles face the same direction reinforces the magnetic field of the plurality of magnets through superposition in accordance with electromagnetic field theory. This advantageously mimics a more powerful magnet providing increased repulsion to sharks.

19 Claims, 10 Drawing Sheets

SHARK GUARD

FIELD OF USE

Shark repellent for ocean sports

BACKGROUND

Magnets are known to deter shark attacks. One common implementation is a wrist band with magnets. Magnetic wrist bands can, however, be ineffective as they only cover the outer extremity of the user. These wrist bands are used for swimming surfing, diving, snorkeling and a variety of other ocean sports. Another known implementation is configuring a swimsuit with magnets to deter sharks. These suits are often ineffective because the orientation of the magnets within the suit are not fixed, and the activity of the user often and easily misaligns the magnets making them ineffective at deterring sharks. What is needed is a device that will both align and fix the magnetics throughout any given device to maximally deter sharks.

SUMMARY

Herein disclosed is device and method of deterring sharks by aligning the poles of each magnet of a plurality of magnets oriented with their magnetic North and South poles on an axis parallel to the top/bottom of an article of manufacture such as a swimsuit, life jacket, surfboard, inflatable lifeboat, inner tube for boating and/or scuba suit. In this device and method each magnet is permanently fixed within an individual pouch contained in a fabric or covering to maintain the alignment of the magnetic poles. Each pouch may retain a single magnet or a plurality of magnets within individual cells in a subdivided grid located within the pouch. Aligning the plurality of magnets such that the magnets' North poles face the same direction reinforces the magnetic field of the plurality of magnets through superposition in accordance with electromagnetic field theory. This advantageously mimics a more powerful magnet providing increased repulsion to sharks.

DETAILED DESCRIPTION

Figure 1A:
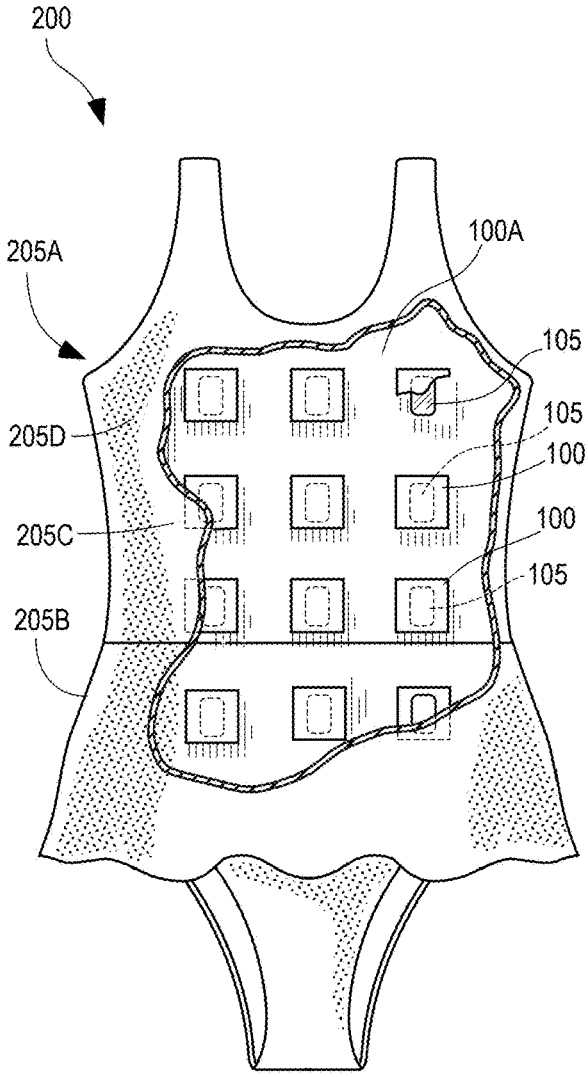
FIGS. 1A-1D show various views of swimsuits configured with an exemplary pouch 100 with a magnet 105 oriented with their magnetic North pole and South pole on an axis parallel to the top and bottom of the swimsuit.
Figure 1B:
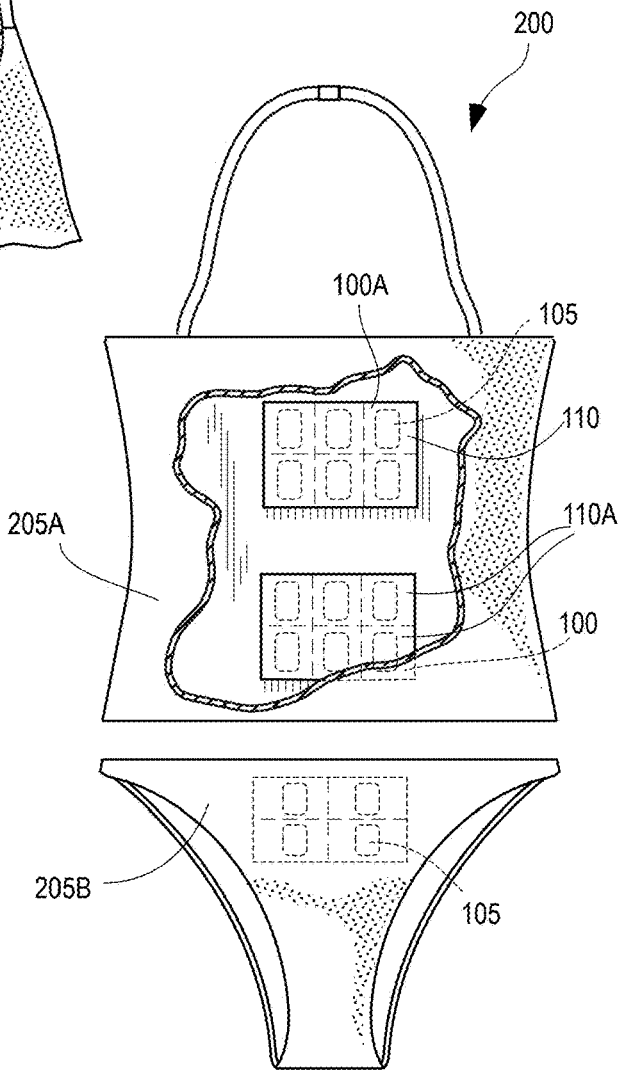
Figure 1C:
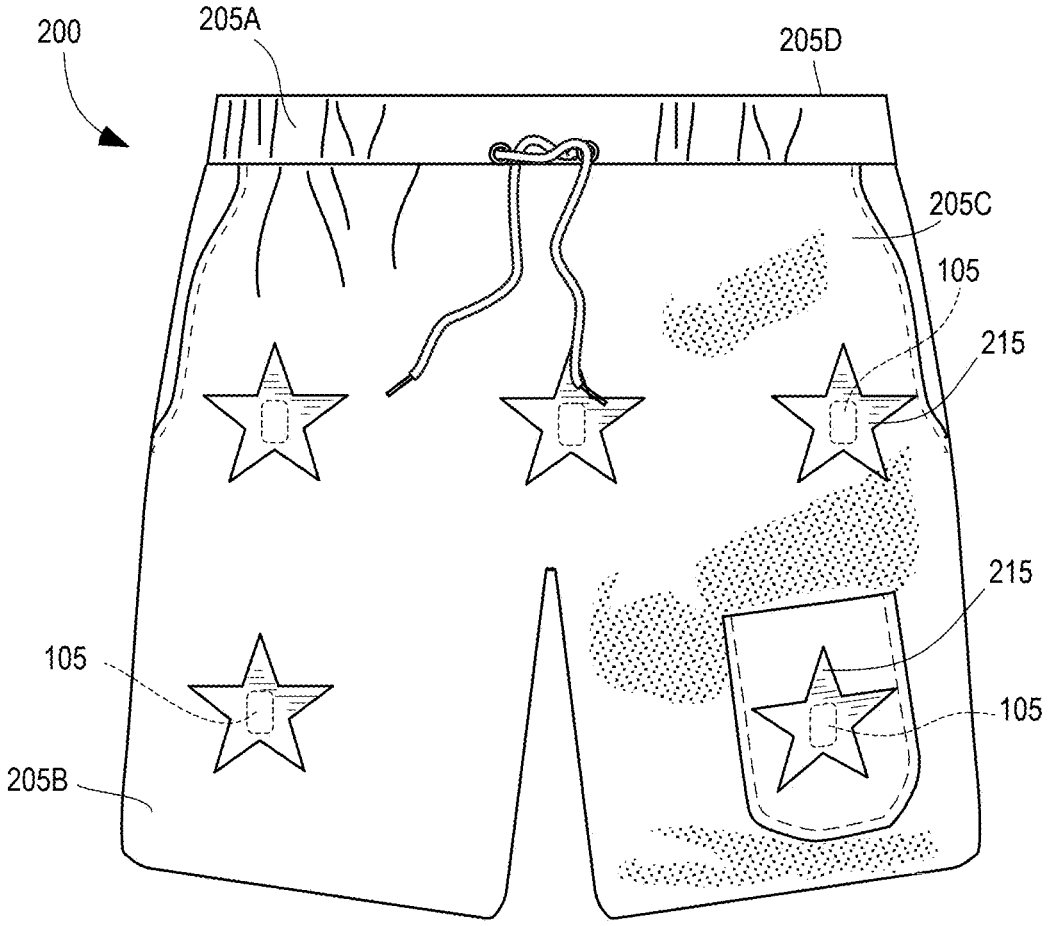
Figure 1D:
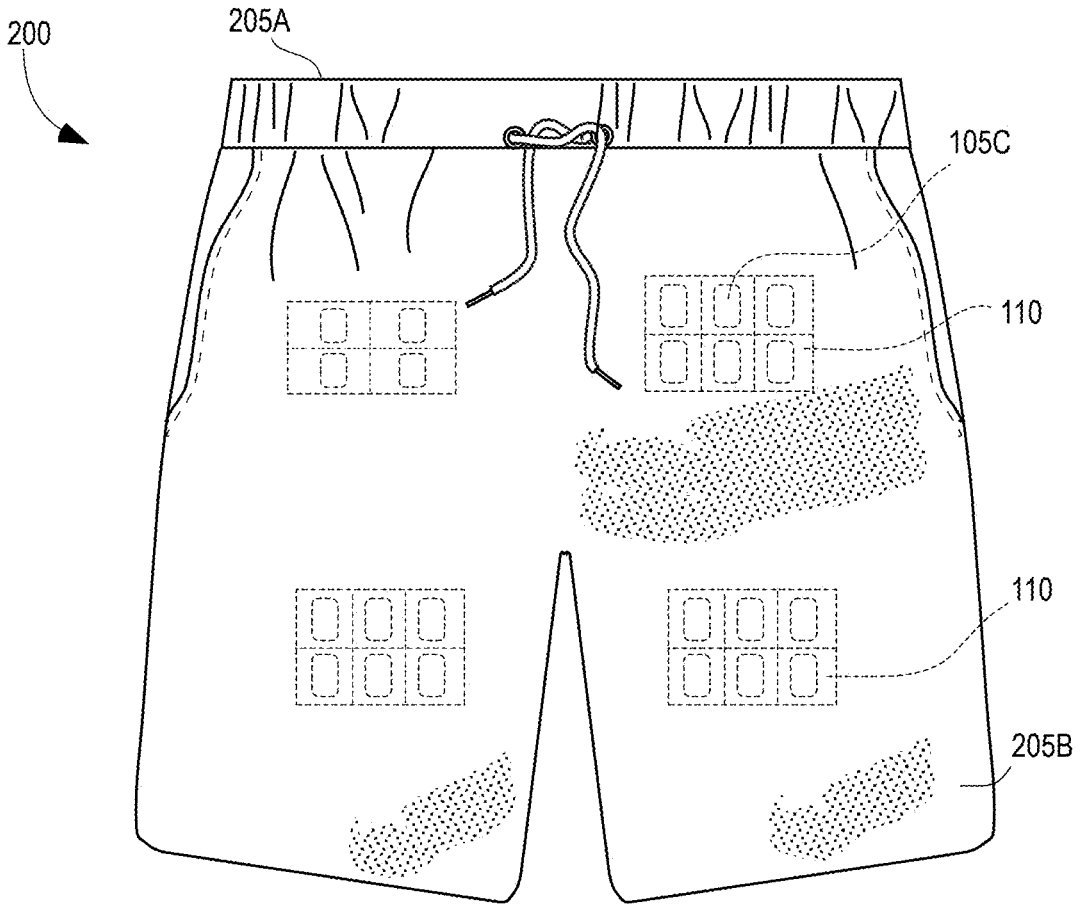

FIGS. 1A-1D, 2A-2B and 3-7 depict various Shark Guard implementations. The details of various aspects are set forth in the accompanying drawing and the description below. Other features and advantages will be apparent from the description and drawing, and from the claims.

In this device and method of deterring sharks, each magnet is permanently fixed within an individual pocket, pouch or fold (hereafter "pouch") of a fabric, lining or covering of an article of manufacture/consumer product to maintain the alignment of the magnetic poles. Each pouch may retain a single magnet or a plurality of magnets within individual cells in a subdivided grid within the pouch. Each pouch holding a single magnet or cell within a pouch is configured to prevent any individual magnet's North and South pole from becoming misaligned with other magnets. Aligning the plurality of magnets such that the magnets' North poles face the same direction reinforces the magnetic field of the plurality of magnets through superposition in accordance with electromagnetic field theory. This arrangement mimics a more powerful magnet providing increased repulsion to sharks. Maintaining the alignment of the magnets' poles may prevent destructive cancellation of the combined magnetic fields, avoiding reduced repulsion to sharks. The magnets may be rare earth magnets. The article of manufacture/consumer product may be a swimsuit, life jacket, surfboard, inner tube for boating, inflatable lifeboat, or scuba gear.

FIG. 1A-1D show various views of swimsuits 200 having a top 205A, a bottom 205B, a front 205C, back 205D and a lining 210 located between an inner fabric 225 and outer fabric 235 of the swimsuit (illustratively shown in FIG. 2B) each comprising a material 220. In one embodiment, the swimsuits 200 are configured with an exemplary pouch 100 wherein each pouch 100 contains a single magnet 105 oriented with their magnetic North pole 105A and South pole 105B (illustratively shown in FIG. 2A) on an axis parallel to the top 205A and the bottom 205B of the swimsuit 200 (hereafter "north-south orientation of the article of manufacture"). In one embodiment, each swimsuit 200 comprises a plurality of pouches 100A that individually retain a magnet 105. In another embodiment, each swimsuit 200 comprises a pouch 100 and/or a plurality of pouches 100A that are subdivided into a grid of cells 110 wherein each cell 110A of in the grid of cells 110 individually retains a single magnet 105.

In one embodiment, the magnets 105 are rare earth magnets that deter sharks. Sharks have very sensitive receptors that use electromagnetic principles to sense their prey. Any magnetic field disrupts that sense causing the sharks to flee. Magnets 105 can be worked into the swimsuit lining 210 (shown illustratively in FIG. 2B) by insertion into pouch 100 or into each cell 110A of a grid of cells 110 within pouch 100 that individually retain a single magnet 105.

In both embodiments the single pouch 100 or each cell 110A in the grid of cells 110 within the pouch 100 hold the magnet 105 immovable with the North pole 105A and south Pole 105 B (shown illustratively in FIG. 2A and FIG. 2B) of the magnet 100 in a north-south position parallel to the swimsuit top 205A and the swimsuit bottom 205B i.e., the "north-south orientation of the article of manufacture. All magnets 105 within the swimsuit 200 are held in parallel to each other so that the North pole 105A and South pole 105B of each magnet 105 are in alignment. Aligning the plurality of magnets 105C such that the magnets' North pole 105A and South pole 105B face the same direction, reinforces the magnetic field formed by the plurality of magnets 105C through superposition in accordance with electromagnetic field theory. This advantageously mimics a more powerful magnet providing increased shark repulsion.

In one embodiment the pouch 100 blends into the material of the swimsuit 200 by fitting within the swimsuit lining 210. In one embodiment, the pouch 100 can be incorporated into a swimsuit embellishment 215 such as but not limited to a logo, design or swim patch (hereafter "patch") of the swimsuit 200. Magnets 105 themselves may be a variety of shapes and sizes such as but not limited to a rectangle, square, oval. The magnets 105 may be hidden completely within the lining 210, pouch 100, and/or embellishment 215. In one embodiment the material 220 of the inner fabric 225 and outer fabric 235 of the swimsuit (illustratively shown in FIG. 2B) are the same. In one embodiment the material 220 of the inner fabric 225 and outer fabric 235 of the swimsuit (illustratively shown in FIG. 2B) are different.

The swimsuit 200 may be of any style, ornamental design, one piece or two, made for children, women and/or men. The magnets 105 may be placed on the front and/or back of the swimsuit 200 so long as they maintain the north-south alignment. The magnets will deter any shark within proximity to the wearer by the magnetic field generated by the magnets. This will keep the wearer safer while swimming. In some cases, a shark pheromone repellent may be added to the swimsuit 200, to help keep sharks away.

In one embodiment, the alignment of the poles of each magnet 105 of the plurality of magnets 105C is adjusted by observing magnetic field lines of the plurality of magnets 105C rendered using iron filings disposed on a paper sheet. In another embodiment, the alignment of the poles of each magnet 105 of the plurality of magnets 105C is adjusted while analyzing the magnetic field lines of the plurality of magnets' 105C using a magnetometer.

Figure 2A:
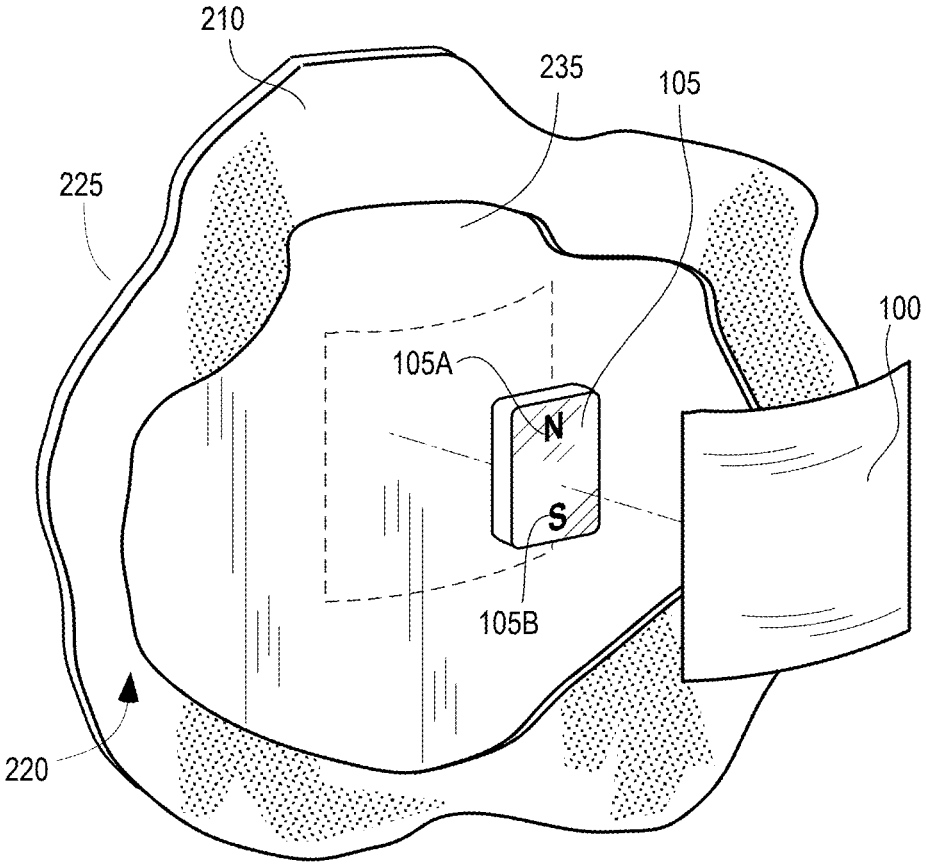
FIG. 2A shows an exploded view of an exemplary pouch 100 configured to retain a magnet 105.

FIG. 2A shows an exploded view of an exemplary magnet alignment system. In the depicted implementation, the magnet alignment system comprises a pouch 100 configured to retain a magnet 105 in an exemplary article of manufacture. In the implementation depicted by FIG. 2A, the pouch 100 material is positioned to secure the magnet 105 oriented with their magnetic North pole 105A and South pole 105B on an axis parallel to the article of manufacture top and bottom. The article of manufacture may be of any type. In the implementation depicted by FIG. 2A, the article of manufacture is a swimsuit. The article of manufacture may be configured with an exemplary pouch 100 retaining a grid of cells 110 with each cell 110A containing an individual magnet 105 (depicted for example at least by FIGS. 1A and 1B). The individual magnets 105 retained by the grid of cells 110 are oriented with their magnetic North pole 105A and South pole 105B on an axis parallel to the swimsuit top 205A and bottom 205B of the swimsuit 200. The pouch 100 may be arranged in a grid of cells 110 of individual cells 110A. Each cell 110A may be configured to hold a magnet 105 and hold the magnet's North pole 105A and South pole 105B from becoming misaligned with a plurality of magnets 105C. In one embodiment, the magnets 105 are located on both the front and back of the swimsuit 200. In the implementation depicted by FIG. 2A, the magnet 105 is located between an inner fabric 225 and an outer fabric 235, wherein the inner fabric 225 and outer fabric 235 comprise material 220. In the depicted implementation, the lining 210 is located between the inner fabric 225 and outer fabric 235.

Figure 2B:
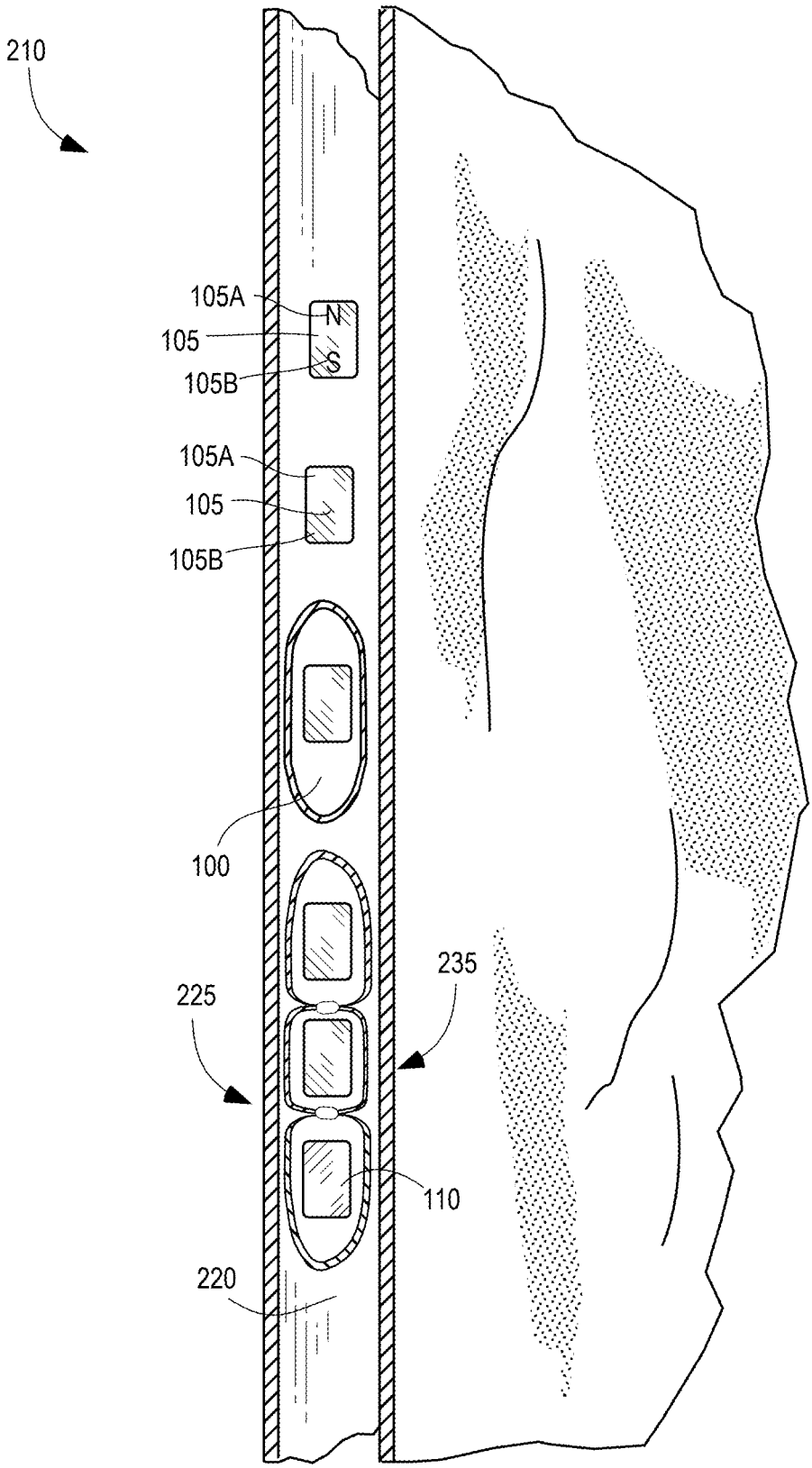
FIG. 2B shows an exemplary magnet 105 located between an inner fabric 225 and an outer fabric 235.

FIG. 2B shows a magnet 105 located between an inner fabric 225 and an outer fabric 235, wherein the inner fabric 225 and outer fabric 235 comprise material 220. It is to be understood by one ordinary skill in the art, that the composition of the material 220 will be different depending on the article of manufacture. The article of manufacture may be a swimsuit, life jacket, surfboard, inner tube for boating, inflatable lifeboat, and/or a scuba suit.

For example, the material 220 for a swimsuit 200 may include but is not limited to nylon, spandex, polyester, stretch polyester, elastane, and/or lycra. Material 220 for a life jacket 300 may include but is not limited to foam, neoprene, nylon and/or polyester fabrics of varying weights (measured in Dtex) that are coated on one or two sides with Thermoplastic Polyurethane (TPU)—a strong, transparent polymer that is highly customizable. Material 220 for a surfboard 400 may include but is not limited to polyurethane foam core (inner material) and a fiberglass or fiberglass cloth (outer material). The material 220 for an inner tube for boating 500 may include but is not limited to butyl rubber, latex, polyvinyl chloride (PVC) and/or vinyl. The material 220 for an inflatable lifeboat 600 may include but is not limited to glass-reinforce plastic, fiberglass-reinforced composite materials, high density polyethylene (HDPE) PVC and/or neoprene hyapalon. The material 220 for a scuba suit 700 may include but is not limited to neoprene, neoprene foam, nylon and/or lycra.

Regardless of the article of manufacture described herein, FIG. 2B illustratively shows a magnet 105 located between an inner fabric 225 and an outer fabric 235, wherein the inner fabric 225 and outer fabric 235 comprise material 220. In one embodiment the material 220 of the inner fabric 225 and outer fabric 235 of the article of manufacture are the same. In one embodiment the material 220 of the inner fabric 225 and outer fabric 235 of the article of manufacture are different.

Exemplary implementations may be configured to maximize the repulsive magnetic field through superposition, which is achieved by aligning the North poles of multiple magnets facing the same direction. The electromagnetic field being applied may be described by Maxwell's equations including Gauss's law. When multiple magnets are arranged in close proximity, their individual magnetic fields interact with each other, resulting in a superposition of the fields. Mathematically, the combined magnetic field of two magnets having their poles aligned along an axis can be determined by considering the individual magnetic fields produced by each magnet in three-dimensional space. When multiple magnets are arranged in close proximity, their individual magnetic fields interact with each other, resulting in a more complex superposition. When the poles of individual magnets are misaligned, their magnetic fields interact with each other in a way that results in destructive interference. In this destructive scenario, the opposing magnetic fields cancel each other out, resulting in a weaker combined magnetic field.

Arrangement of individual magnets may be optimized to minimize any opposing fields, thereby maximizing the strength and directionality of the resulting magnetic field. The combined magnetic field produced by the magnet alignment device may be much stronger than a single magnet with its pole aligned parallel to the top/bottom of an article of manufacture. This may be achieved through the strategic arrangement of multiple individual magnets, which allows for optimal superposition of their individual magnetic fields. A device designed to achieve a stronger magnetic field using multiple aligned smaller-size magnets may result in a lower total magnet weight than a device using fewer but larger magnets. A device achieving lower magnet weight may permit a user increased mobility, flexibility and reduced energy required for swimming or surfing, while repelling sharks.

An exemplary implementation may comprise multiple magnets each secured by an individual pouch contained in a fabric or covering to maintain the alignment of the magnetic poles of at least a portion of the magnets. To repel sharks using electromagnetic fields, an exemplary device implementation may be configured with rare earth magnets such as for example, but not limited to, Neodymium (NdFeB) magnets. Such rare earth magnets may be selected due to their high coercivity, remanence, and magnetic strength. In an illustrative example, a neodymium magnet may have a maximum magnetic field strength of 1-2 Tesla (T), which may be sufficient for repelling sharks.

Sharks have been found to possess a magnetoreceptive system that enables them to detect and respond to the Earth's magnetic field (EMF). This ability is thought to play a crucial role in the migration, foraging, and social behavior of sharks. The EMF generated by the Earth's core is composed of two primary components: the geomagnetic field (GMF) and the magnetic declination (MD). The GMF is the dominant component, with a strength of approximately 50 μT at sea level.

Magnetoreception in sharks is a complex phenomenon that involves the detection of the Earth's magnetic field (EMF) through specialized receptors. Sharks may exhibit different behavioral responses to varying strengths of magnetic fields. For example, in the presence of strong magnetic fields (≥10 μT), sharks tend to align their bodies parallel to the magnetic field lines and make sharp turns, suggesting that they are using the EMF to navigate. In contrast, weak magnetic fields (<1 μT) have been shown to elicit a "false" magnetoreceptive response, characterized by increased swimming activity and changes in swimming patterns.

The shark's response to magnetic fields varies depending on the strength and orientation of the EMF, with stronger fields eliciting more pronounced behavioral responses. While the minimum magnetic field strength needed to repel a shark is not well defined, it is thought to be in the range of 10-100 μT. Studies have shown that sharks can detect and respond to magnetic fields as weak as 1 μT, while stronger fields are required to elicit a significant behavioral response.

A shark's response to magnetic fields is thought to be mediated by a network of magnetoreceptors in the shark's head, which communicate with the brain via the optic nerve. The magnetoreceptive system of sharks is believed to be based on the presence of specialized receptors called cryptochromes, which are sensitive to magnetic fields. These receptors are thought to be responsible for detecting the orientation of the EMF and may be located in the retina or other parts of the visual system.

Various exemplary implementations may be configured with at least one rare earth magnet. The at least one rare earth magnet may be a neodymium magnet. The at least one magnet may have a magnetic field strength of at least 0.5 Tesla. Some designs may be configured with a rare earth magnet having a magnetic field strength of up to 1 Tesla. Various embodiments may be configured with a rare earth magnet having a magnetic field strength of up to 2 Tesla. In some cases, an exemplary device may be configured with multiple rare earth magnets having a combined field strength from 0.5 Tesla up to 2 Tesla or greater, depending on the desired repulsive force. Ferrite magnets may also be used, but their lower coercivity and remanence make them less suitable for this application.

An exemplary implementation may comprise a magnet alignment system. The magnet alignment system may further comprise multiple individual pouches, each containing a magnet with its magnetic North and South poles oriented on an axis parallel to the top/bottom of the article. The pouches are arranged in a configuration that maximizes the combined electromagnetic field through superposition. The arrangement is designed such that the magnetic fields of adjacent magnets are aligned, thereby canceling out any opposing fields and resulting in a stronger, directional magnetic field.

To maintain magnet alignment over time, individual pouches may be designed with features that address thermal expansion, humidity, and mechanical stress. For example, some magnet pouch designs may be configured with a thermally stable fabric, such as polyester or nylon, to minimize thermal expansion. An exemplary pouch may be sealed such that the pouch is waterproof and/or incorporates moisture-resistant materials to prevent magnet damage from water ingress or from humidity. To maintain magnet alignment, each pouch can contain a single magnet or multiple small magnets arranged in a subdivided grid. This will create a uniform magnetic field while minimizing individual magnet movement due to thermal expansion or mechanical stress.

In an illustrative example, an exemplary pouch may be configured with at least one translucent section configured to permit a user to see a portion of a magnet while the magnet is retained by the at least one pouch. The translucent section may be, for example, clear plastic, permitting a user to view the magnet through the translucent section. Viewing the magnet may permit the user to confirm the type and/or orientation of the magnet in the pouch. For example, a user preparing to enter shark-infested waters may gain confidence by virtue of being able to confirm the rated strength of the magnets installed in their device, by viewing identifying marks on the magnets. Such a user may gain further confidence in the degree of shark protection provided by their device as a result of confirming the intended alignment of the magnets based on viewing identifying marks on the magnets. The magnets may be marked with identification of one or more magnetic pole. For example, location of north poles may be verified during manufacturing and the north poles marked with a Red "N." South poles may be marked. The poles may be marked in any color. A method to make or use the device may comprise installing and aligning a plurality of magnets in a plurality of pouches based on aligning markings identifying like poles of the plurality of magnets while viewing the markings through a plurality of translucent sections disposed in the plurality of pouches. The like poles may be north poles. The like poles may be south poles.

Figure 3:
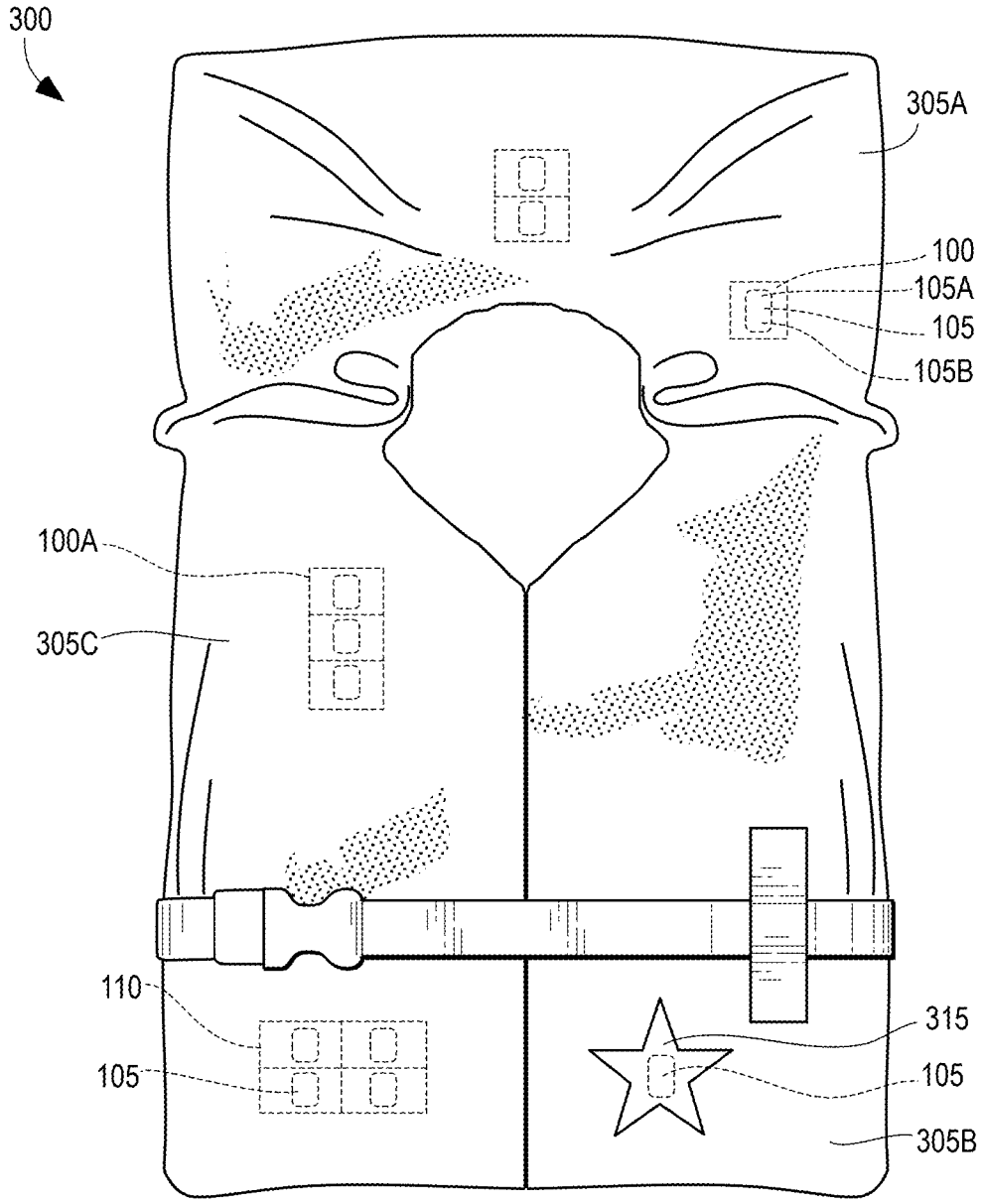
FIG. 3 shows a life jacket configured with an exemplary pouch 100 with a magnet 105 oriented with their magnetic North and South poles on an axis parallel to the plane of the fabric or covering.

FIG. 3 shows a life jacket 300 have a top 305A, a bottom 305B, a front 305C, a back 3055D and a lining located between an inner fabric 225 and outer fabric 235 wherein each fabric comprises material 225 (as shown illustratively in FIG. 2B). The life jacket 300 is configured with an exemplary pouch 100 with a magnet 105 oriented with their magnetic North pole 105A and South pole 105B on an axis parallel to the life jacket top 305 A and life jacket bottom 305B i.e., the "north-south orientation of the article of manufacture.

In one embodiment, each life jacket 300 comprises a plurality of pouches 100A wherein each pouch 100 of the plurality of pouches 100A individually retains a magnet 105. In another embodiment, the life jacket 300 comprises a pouch 100 or a plurality of pouches 100A that are subdivided into a grid of cells 110 that individually retain a single magnet 105. In one embodiment, the magnets 105 can be located between the inner fabric 225 and outer fabric 235 wherein each fabric comprises material 220, whether by insertion into pouch 100 or into a grid of cells 110 within pouch 100 that individually retain a single magnet 105.

In both embodiments the pouch 100 or the grid of cells within the pouch 110, each hold the magnet 105 immovable with the North pole 105A and south Pole 105 B of the magnet 100 in a north-south position parallel to the life jacket top 305A and the life jacket bottom 305B, i.e., the "north-south orientation of the article of manufacture. Each magnet 105 within the life jacket 300 are held in parallel to each other so that the North pole 105A and South pole 105B of each magnet 105 is in the same alignment. Aligning the plurality of magnets such that the magnets' North pole 105A and South pole 105B face the same direction, reinforces the magnetic field of the plurality of magnets 100A through superposition in accordance with electromagnetic field theory. This advantageously mimics a more powerful magnet providing increased shark repulsion.

In one embodiment the pouch 100 blends into the material 220 of the life jacket 300. In one embodiment, the pouch 100 can be incorporated into a life jacket 300 embellishment 315 such as but not limited to a logo, design or swim patch (hereafter "patch") of the life jacket 300. Magnets 105 themselves may be a variety of shapes and sizes such as but not limited to a rectangle, square, oval. The magnets 105 may be hidden completely within the pouch 100. The pouch 100 may be hidden within the life jacket 300 lining 310 (as shown illustratively in FIG. 2B) or within the life jacket 300 embellishment 315.

The life jacket 300 may be of any style, size, or color, made for children, women and/or men. The magnets 105 may be placed on the front and/or back of the life jacket 300 so long as they maintain the north south alignment. The plurality of magnets 105A will deter any shark within proximity to the wearer by the magnetic field generated by the plurality of magnets 105A. This will keep the wearer safer while swimming. In some cases, a shark pheromone repellent may be added to the life jacket 300, to help keep sharks away. In one embodiment the material 220 of the inner fabric 225 and outer fabric 235 of the life jacket are the same. In one embodiment the material 220 of the inner fabric 225 and outer fabric 235 of the life jacket are different.

Figure 4:
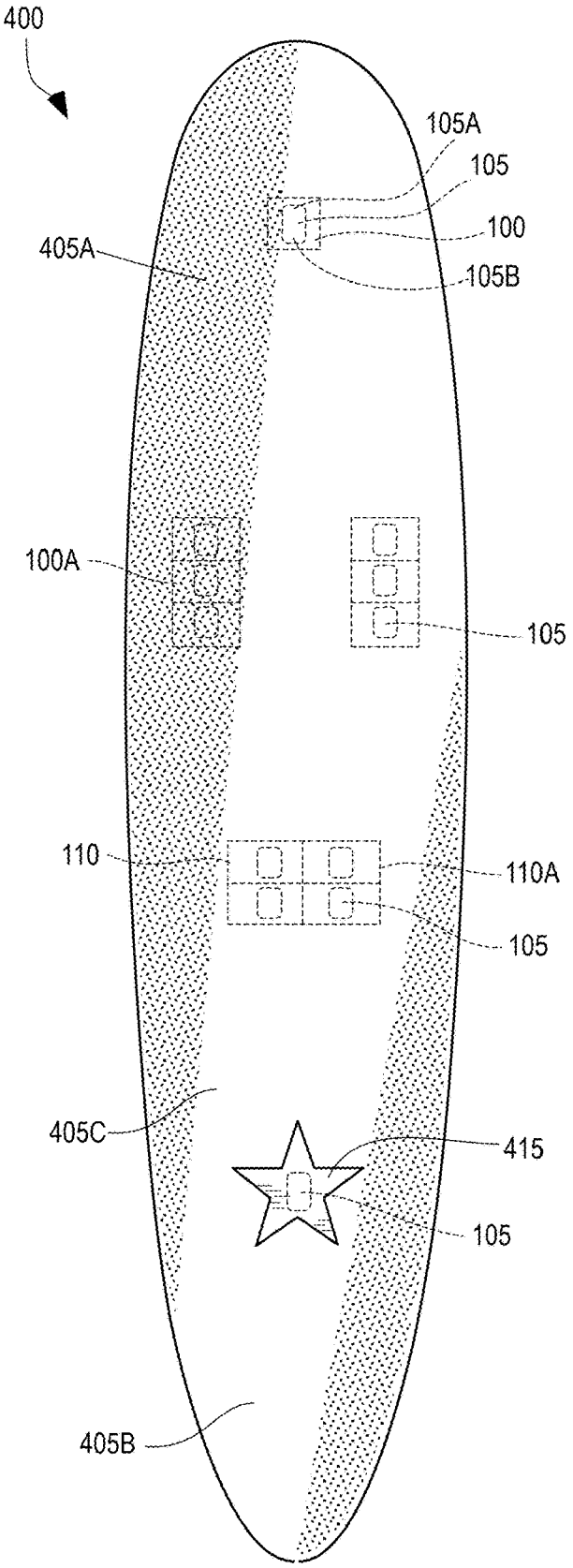
FIG. 4 shows a surfboard cover configured with an exemplary pouch 100 with a magnet 105 oriented with their magnetic North and South poles on an axis parallel to the plane of the fabric or covering.

FIG. 4 shows a surfboard 400 having a top 405A, a bottom 405B, a front 405C, a back 405D and a lining 410 encapsulating the entire surfboard 400 wherein the lining 410 is located between an inner fabric 225 and outer fabric 235 each comprising a material 220 (as shown illustratively in FIG. 2B). In one embodiment, the surfboard 400 is configured with an exemplary pouch 100 with a magnet 105 oriented with their magnetic North pole 105A and South pole 105B on an axis parallel to the surfboard top 405A and surfboard bottom 405B, i.e., the "north-south orientation of the article of manufacture.

In one embodiment, each surfboard 400 comprises a plurality of pouches 100A wherein each pouch 100 of the plurality of pouches 100A individually retains a magnet 105. In another embodiment, each surfboard 400 comprises a pouch 100 and/or a plurality of pouches 100A that are subdivided into a grid of cells 110 with each cell 110A individually retaining a single magnet 105. In one embodiment, the magnets 105 can be worked into the surfboard lining 410 of surfboard 400, whether by insertion into pouch 100 or into a grid of cells 110 within pouch 100 that individually retain a single magnet 105.

In both embodiments the pouch 100 or, each cell 110A of the grid of cells 110 within the pouch 100, holds the magnet 105 immovable with the North pole 105A and south Pole 105 B of the magnet 100 in a north-south position parallel to the surfboard top 405A and the surfboard bottom 405B, i.e., the "north-south orientation of the article of manufacture. All magnets 100 within the surfboard 400 are held in parallel to each other so that the North pole 105A and South pole 105B of each magnet 100 is in alignment. Aligning the plurality of magnets 105C such that the magnets' North pole 105A and South pole 105B face the same direction, reinforces the magnetic field of the plurality of magnets 100C through superposition in accordance with electromagnetic field theory. This advantageously mimics a more powerful magnet providing increased shark repulsion.

In one embodiment the pouch 100 blends into the material 220 of the surfboard 400. In one embodiment, the pouch 100 can be incorporated into a surfboard 400 embellishment 415 such as but not limited to a logo, design or swim patch (hereafter "patch") of the surfboard 400. Magnets 105 themselves may be a variety of shapes and sizes such as but not limited to a rectangle, square, oval. The magnets 105 may be hidden completely within the pouch 100. The pouch 100 may be hidden within the surfboard 400 lining 410 or within the surfboard 400 embellishment 415.

The surfboard 400 may be of any style, size, or color, made for children, women and/or men. The magnets 105 may be placed on the front and/or back of the surfboard 400 so long as they maintain the north south alignment. The magnets will deter any shark within proximity to the wearer by the magnetic field generated by the magnets. This will keep the wearer safer while swimming. In some cases, a shark pheromone repellent may be added to the surfboard 400, to help keep sharks away. In one embodiment the material 220 of the inner fabric 225 and outer fabric 235 of the surfboard (illustratively shown in FIG. 2B) are the same. In one embodiment the material 220 of the inner fabric 225 and outer fabric 235 of the surfboard (illustratively shown in FIG. 2B) are the different.

Figure 5:
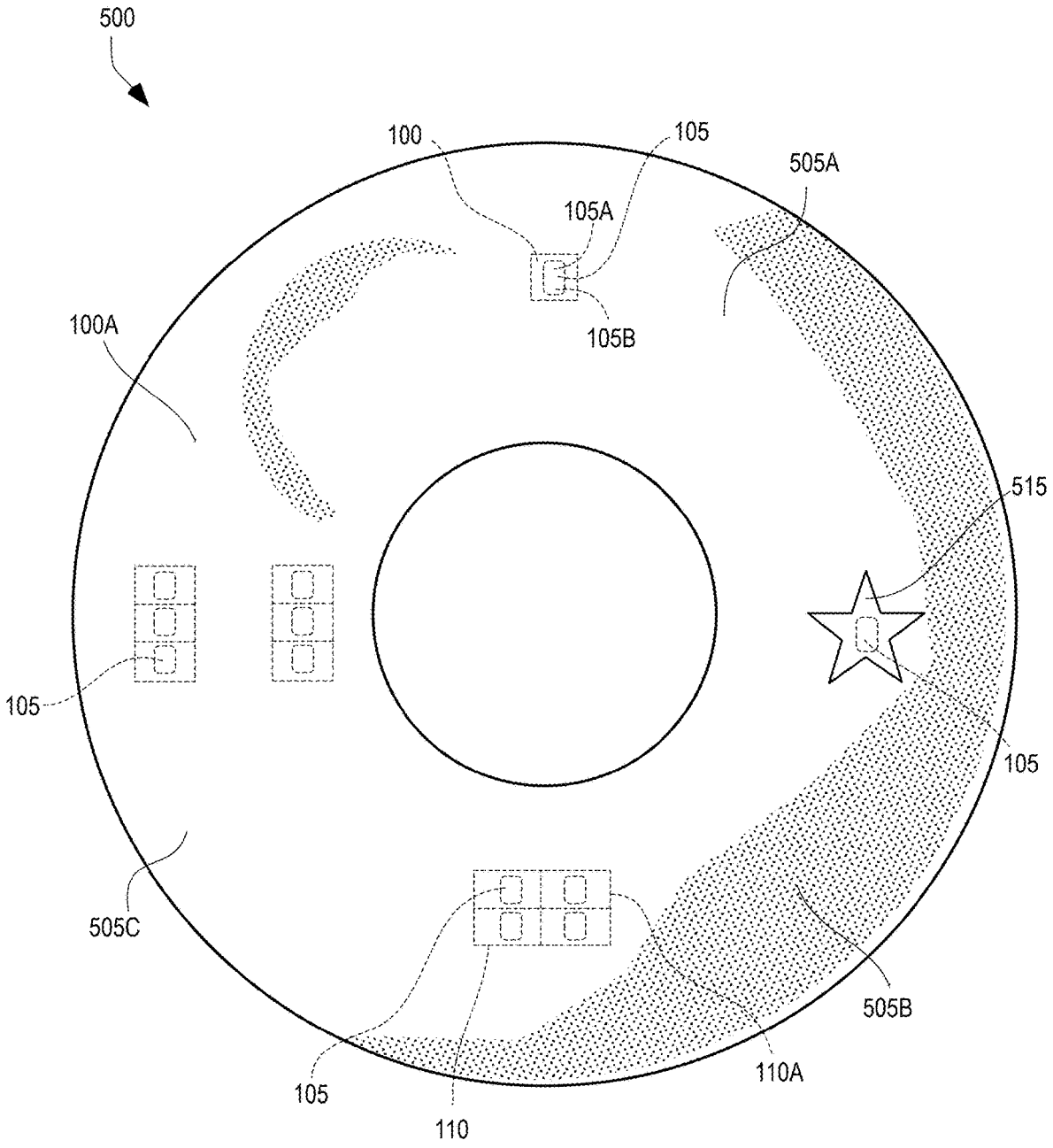
FIG. 5 shows an inner tube for boating configured with an exemplary pouch 100 with a magnet 105 oriented with their magnetic North and South poles on an axis parallel to the plane of the fabric or covering.

FIG. 5 shows an inner tube 500 having a forward end 505A a backward end 505B, a top 505C, a bottom 505D and a lining 510 encapsulating the entire inner tube 500 wherein the lining 510 is located between an inner fabric 225 and outer fabric 235 (as shown illustratively in FIG. 2B). In one embodiment, the inner tube 500 is configured with an exemplary pouch 100 with a magnet 105 oriented with their magnetic North pole 105A and South pole 105B on an axis parallel to the inner tube forward end 505A and inner tube backward end 505B, i.e., the "north-south orientation of the article of manufacture.

In one embodiment, each inner tube 500 comprises a plurality of pouches 100A wherein each pouch 100 of the plurality of pouches 100A individually retains a magnet 105. In another embodiment, each inner tube 500 comprises a pouch 100 and/or a plurality of pouches 100A that are subdivided into a grid of cells 110 wherein each cell 110A of the grid of cells 110 retains a single magnet 105. In one embodiment, the magnets 105 can be worked into the of inner tube lining 510 of inner tube 500, by insertion into pouch 100 or into individual cells 110A of the grid of cells 110 within pouch 100 that individually retain a single magnet 105.

In both embodiments the pouch or, the cell 110A within the grid of cells within the pouch, each holds the magnet 105 immovable with the North pole 105A and south Pole 105 B of the magnet 100 in a north-south position parallel to the inner tube forward end 505A and the inner tube backward end 505B, i.e., the "north-south orientation of the article of manufacture. All magnets 100 within the inner tube 500 are held in parallel to each other so that the North pole 105A and South pole 105B of each magnet 100 is in alignment. Aligning the plurality of magnets 105C such that the magnets' North pole 105A and South pole 105B face the same direction, reinforces the magnetic field of the plurality of magnets 105C through superposition in accordance with electromagnetic field theory. This advantageously mimics a more powerful magnet providing increased shark repulsion.

In one embodiment the pouch 100 blends into the material of the inner tube 500. In one embodiment, the pouch 100 can be incorporated into an inner tube 500 embellishment 515 such as but not limited to a logo, design or swim patch (hereafter "patch") of the inner tube 500. Magnets 105 themselves may be a variety of shapes and sizes such as but not limited to a rectangle, square, oval. The magnets 105 may be hidden completely within the pouch 100. The pouch 100 may be hidden within the inner tube 500 lining 510 or within the inner tube 500 embellishment 515.

The inner tube 500 may be of any style, size, or color, made for children, women and/or men. The magnets 105 may be placed on the front and/or back of the inner tube 500 so long as they maintain the north south alignment. The magnets will deter any shark within proximity to the wearer by the magnetic field generated by the magnets. This will keep the wearer safer while swimming. In some cases, a shark pheromone repellent may be added to the inner tube 500, to help keep sharks away. In one embodiment, the inner tube 500 is towable by a boat. In one embodiment the material 220 of the inner fabric 225 and outer fabric 235 of the inner tube for boating (illustratively shown in FIG. 2B) are the same. In one embodiment the material 220 of the inner fabric 225 and outer fabric 235 of the inner tube for boating (illustratively shown in FIG. 2B) are the different.

Figure 6:
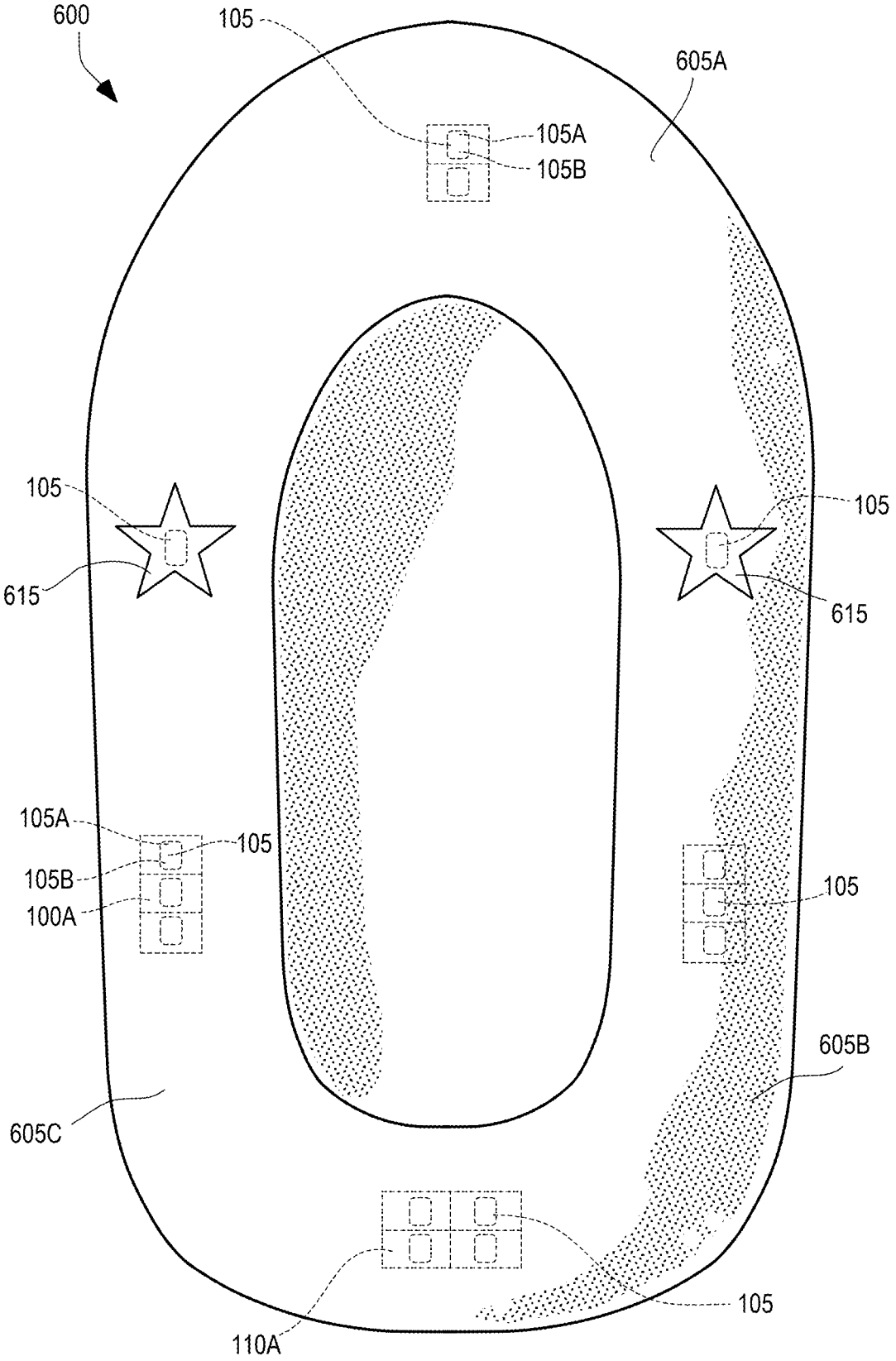
FIG. 6 shows an inflatable lifeboat configured with an exemplary pouch 100 with a magnet 105 oriented with their magnetic North and South poles on an axis parallel to the plane of the fabric or covering.

FIG. 6 shows an inflatable lifeboat 600 having a forward end 605A a backward end 605B, a top 605C, a bottom 605D and a lining 610 encapsulating the entire lifeboat 600 wherein the lining 610 is located between an inner fabric or material 225 and outer fabric or material 235 of the lifeboat 600 (as shown illustratively in FIG. 2B). In one embodiment, the lifeboat 600 is configured with an exemplary pouch 100 with a magnet 105 oriented with their magnetic North pole 105A and South pole 105B on an axis parallel to the lifeboat forward end 605A and lifeboat backward end 605B i.e., the "north-south orientation of the article of manufacture.

In one embodiment, each lifeboat 600 comprises a plurality of pouches 100 wherein each pouch 100 of the plurality of pouches 100A individually retains a magnet 105C. In another embodiment, each lifeboat 600 comprises a plurality of pouches 100A wherein each pouch 100 of the plurality of pouches 100A is subdivided into a grid of cells 110 wherein each cell 110A of the grid of cells 110 individually retains a single magnet 105. In one embodiment, the magnets 105 can be worked into the of lifeboat lining 610 of lifeboat 600, whether by insertion into pouch 100 or into a grid of cells 110 within pouch 100 that individually retain a single magnet 105.

In both embodiments the pouch or, each cell 110A within the grid of cells 110 within the pouch 100, holds a magnet 105 immovable with the North pole 105A and south Pole 105 B of the magnet 100 in a north-south position parallel to the lifeboat forward end 605A and the lifeboat backward end 605B, i.e., the "north-south orientation of the article of manufacture. All magnets 105C within the lifeboat 600 are held in parallel to each other so that the North pole 105A and South pole 105B of each magnet 105 is in alignment. Aligning the plurality of magnets 105C such that the magnets' North pole 105A and South pole 105B face the same direction, reinforces the magnetic field of the plurality of magnets 105C through superposition in accordance with electromagnetic field theory. This advantageously mimics a more powerful magnet providing increased shark repulsion.

In one embodiment the pouch 100 blends into the material of the lifeboat 600. In one embodiment, the pouch 100 can be incorporated into a lifeboat 600 embellishment 615 such as but not limited to a logo, design or swim patch (hereafter "patch") of the lifeboat 600. Magnets 105 themselves may be a variety of shapes and sizes such as but not limited to a rectangle, square, oval. The magnets 105 may be hidden completely within the pouch 100. The pouch 100 may be hidden within the lifeboat 600 lining 610 or within the lifeboat 600 embellishment 615.

The inflatable lifeboat 600 may be of any style, size, or color, made for children, women and/or men. The magnets 105 may be placed on the front and/or back of the inflatable lifeboat 600 so long as they maintain the north south alignment. The magnets will deter any shark within proximity to the wearer by the magnetic field generated by the magnets. This will keep the wearer safer while swimming. In some cases, a shark pheromone repellent may be added to the lifeboat 600, to help keep sharks away. In one embodiment, the inflatable lifeboat 600 is an inflatable life raft. In one embodiment, the inflatable lifeboat 600 is a rigid inflatable boat. In one embodiment the material 220 of the inner fabric 225 and outer fabric 235 of the inflatable lifeboat 600 (illustratively shown in FIG. 2B) are the same. In one embodiment the material 220 of the inner fabric 225 and outer fabric 235 of the inflatable lifeboat 600 (illustratively shown in FIG. 2B) are the different.

Figure 7:
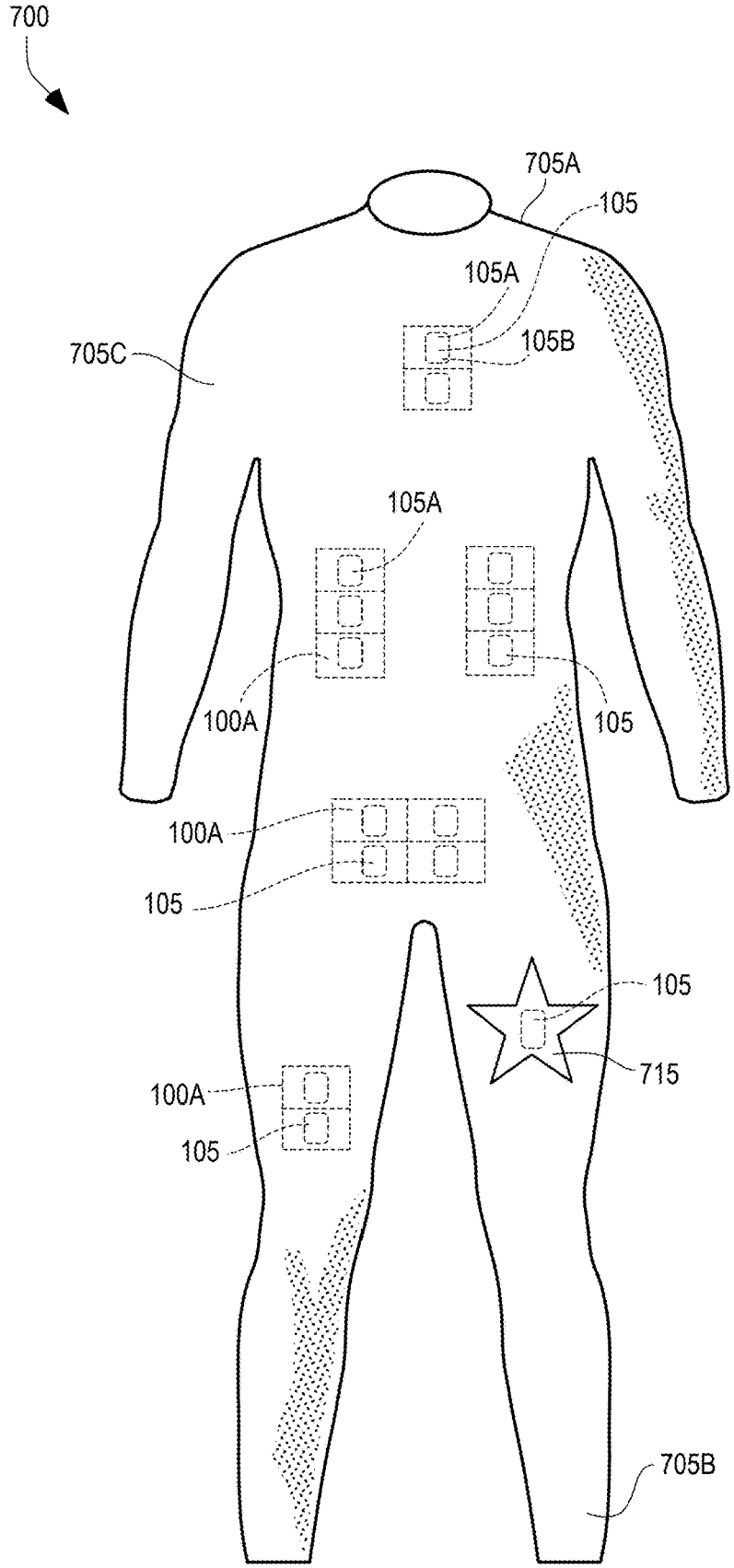
FIG. 7 shows scuba suit configured with an exemplary pouch 100 with a magnet 105 oriented with their magnetic North and South poles on an axis parallel to the plane of the fabric or covering.

FIG. 7 shows scuba suit 700 having a top 705A, a bottom 705B, a front 705C, a back 705D and a lining 710 encapsulating the entire scuba suit 700 wherein the lining 710 is located between an inner fabric or material 225 and outer fabric or material 235 of the scuba suit 700 (as shown illustratively in FIG. 2B). In one embodiment, the scuba suit 700 is configured with an exemplary pouch 100 with a magnet 105 oriented with their magnetic North pole 105A and South pole 105B on an axis parallel to the scuba suit top 705A and scuba suit bottom 405B i.e., the "north-south orientation of the article of manufacture.

In one embodiment, scuba suit 700 comprises a plurality of pouches 100 wherein each pouch 100 of the plurality of pouches 100A individually retains a magnet 105. In another embodiment, each scuba suit 700 comprises a plurality of pouches 100 that are subdivided into a grid of cells 110 that individually retain a single magnet 105.

In one embodiment, the magnets 105 are rare earth magnets that deter sharks. Sharks have very sensitive receptors that use electromagnetic principles to sense their prey. Any magnetic field disrupts that sense causing the sharks to flee. Magnets 105 can be worked into the scuba suit 700 fabric 720, whether by insertion into pouch 100 or into a grid of cells 110 within pouch 100 that individually retain a single magnet 105.

In both embodiments the pouch or each cell 110A within the grid of cells 110 within the pouch 100 holds the magnet 105 immovable with the North pole 105A and south Pole 105 B of the magnet 100 in a north-south position parallel to the scuba suit 700 top 705A and the scuba suit 700 bottom 705B, i.e., the "north-south orientation of the article of manufacture. All magnets 105C within the scuba suit 700 are held in parallel to each other so that the North pole 105A and South pole 105B of each magnet 105 is in alignment. Aligning the plurality of magnets 105C such that the magnets' North pole 105A and South pole 105B face the same direction, reinforces the magnetic field of the plurality of magnets 105C through superposition in accordance with electromagnetic field theory. This advantageously mimics a more powerful magnet providing increased shark repulsion.

In one embodiment the pouch 100 blends into the material of a scuba suit 700. In one embodiment, the pouch 100 can be incorporated into a scuba suit embellishment 15 such as but not limited to a logo, design or swim patch (hereafter "patch") of the scuba suit 700. Magnets 105 themselves may be a variety of shapes and sizes such as but not limited to a rectangle, square, oval. The magnets 105 may be hidden completely within the pouch 100. The pouch 100 may be hidden within the scuba suit lining 710 or within the scuba suit embellishment 715.

The scuba suit 700 may be of any style, ornamental design, one piece or two, made for children, women and/or men. The magnets 105 may be placed on the front and/or back of the scuba suit 700 so long as they maintain the north south alignment. The magnets will deter any shark within proximity to the wearer by the magnetic field generated by the magnets. This will keep the wearer safer while swimming. In some cases, a shark pheromone repellent may be added to scuba suit 700, to help keep sharks away. In one embodiment the material 220 of the inner fabric 225 and outer fabric 235 of the scuba suit 700 (illustratively shown in FIG. 2B) are the same. In one embodiment the material 220 of the inner fabric 225 and outer fabric 235 of the scuba suit 700 (illustratively shown in FIG. 2B) are the different.

Implementation 1. A method comprising: inserting a plurality of magnets into an article of manufacture, wherein the article of manufacture comprises at least one pouch configured to retain at least one magnet of the plurality of magnets; aligning north and south poles of each magnet of the plurality of magnets inserted into the article of manufacture with a north-south orientation of the article of manufacture; and configuring the at least one pouch to maintain alignment of each magnet of the plurality of magnets with the north-south orientation of the article of manufacture.

Implementation 2. The method of implementation 1, wherein at least one magnet of the plurality of magnets is a rare earth magnet.

Implementation 3. The method of implementation 2, wherein the rare earth magnet comprises neodymium.

Implementation 4. The method of implementation 1, wherein at least one magnet of the plurality of magnets has a magnetic field strength of at least 0.5 Tesla.

Implementation 5. The method of implementation 1, wherein at least one magnet of the plurality of magnets has a magnetic field strength of from 0.5 Tesla to 2 Tesla.

Implementation 6. The method of implementation 1, wherein the at least one pouch is subdivided into a grid of individual cells and each cell is configured to retain at least one magnet of the plurality of magnets.

Implementation 7. The method of implementation 6, wherein each cell is configured to maintain the alignment of each magnet of the plurality of magnets with the north-south orientation of the article of manufacture.

Implementation 8. The method of implementation 1, wherein aligning north and south poles of each magnet of the plurality of magnets further comprises adjusting the alignment of the plurality of magnets while observing magnetic field lines rendered by the plurality of magnets in the article of manufacture using iron filings disposed on a paper sheet.

Implementation 9. The method of implementation 1, wherein aligning north and south poles of each magnet of the plurality of magnets further comprises adjusting the alignment of the plurality of magnets while analyzing magnetic field lines of the plurality of magnets in the article of manufacture, using a magnetometer.

Implementation 10. The method of implementation 1, wherein the article of manufacture is a swimsuit.

Implementation 11. The method of implementation 1, wherein the plurality of magnets is inserted into a lining of the article of manufacture.

Implementation 12. The method of implementation 10, wherein the swimsuit has a top, a bottom, a front, and a back.

Implementation 13. The method of implementation 12, wherein the method further comprises disbursing the plurality of magnets throughout the front and back of the swimsuit.

Implementation 14. The method of implementation 1, wherein the method further comprises configuring the at least one pouch to be waterproof.

Implementation 15. The method of implementation 1, wherein the method further comprises configuring the at least one pouch with at least one translucent section configured to permit a user to see a portion of a magnet while the magnet is retained by the at least one pouch.

Implementation 16. The method of implementation 1, wherein the method further comprises configuring at least one magnet of the plurality of magnets with a marking identifying a pole of the at least one magnet.

Implementation 17. The method of implementation 16, wherein the marking has a color selected from the group consisting of Red, Green, Blue, Yellow, Orange and White.

Implementation 18. The method of implementation 1, wherein the method further comprises installing and aligning a plurality of magnets in a plurality of pouches based on aligning markings identifying like poles of the plurality of magnets while viewing the markings through a plurality of translucent sections disposed in the plurality of pouches.

Implementation 19. The method of implementation 18, wherein the like poles are north poles.

Implementation 20. The method of implementation 18, wherein the like poles are south poles.

In the Summary above and in this Detailed Description, and the Claims below, and in the accompanying drawings, reference is made to particular features of various implementations. It is to be understood that the disclosure of particular features of various implementations in this specification is to be interpreted to include all possible combinations of such particular features. For example, where a particular feature is disclosed in the context of a particular aspect or implementation, or a particular claim, that feature can also be used, to the extent possible, in combination with and/or in the context of other particular aspects and implementations, and in an implementation generally.

While multiple implementations are disclosed, still other implementations will become apparent to those skilled in the art from this detailed description. Disclosed implementations may be capable of myriad modifications in various obvious aspects, all without departing from the spirit and scope of the disclosed implementations. Accordingly, the drawings and descriptions are to be regarded as illustrative in nature and not restrictive.

It should be noted that the features illustrated in the drawings are not necessarily drawn to scale, and features of one implementation may be employed with other implementations as the skilled artisan would recognize, even if not explicitly stated herein. Descriptions of well-known components and processing techniques may be omitted so as to not unnecessarily obscure the implementation features.

In the present disclosure, various features may be described as being optional, for example, through the use of the verb "may;" or, through the use of any of the phrases: "in some implementations," "in some designs," "in various implementations," "in various designs," "in an illustrative example," or, "for example." For the sake of brevity and legibility, the present disclosure does not explicitly recite each and every permutation that may be obtained by choosing from the set of optional features. However, the present disclosure is to be interpreted as explicitly disclosing all such permutations. For example, a system described as having three optional features may be implemented in seven different ways, namely with just one of the three possible features, with any two of the three possible features or with all three of the three possible features.

In various implementations, elements described herein as coupled or connected may have an effectual relationship realizable by a direct connection or indirectly with one or more other intervening elements.

In the present disclosure, the term "any" may be understood as designating any number of the respective elements, i.e. as designating one, at least one, at least two, each or all of the respective elements. Similarly, the term "any" may be understood as designating any collection(s) of the respective elements, i.e. as designating one or more collections of the respective elements, a collection comprising one, at least one, at least two, each or all of the respective elements. The respective collections need not comprise the same number of elements.

While various implementations have been disclosed and described in detail herein, it will be apparent to those skilled in the art that various changes may be made to the disclosed configuration, operation, and form without departing from the spirit and scope thereof. In particular, it is noted that the respective implementation features, even those disclosed solely in combination with other implementation features, may be combined in any configuration excepting those readily apparent to the person skilled in the art as nonsensical. Likewise, use of the singular and plural is solely for the sake of illustration and is not to be interpreted as limiting.

The Abstract is provided to comply with 37 C. F. R. § 1.72(b), to allow the reader to quickly ascertain the nature of the technical disclosure and is submitted with the understanding that it will not be used to interpret or limit the scope or meaning of the claims.

In the present disclosure, any method or apparatus implementation may be devoid of one or more process steps or components. In the present disclosure, implementations employing negative limitations are expressly disclosed and considered a part of this disclosure.

Certain terminology and derivations thereof may be used in the present disclosure for convenience in reference only and will not be limiting. For example, words such as "top," "bottom," "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The term "comprises" and grammatical equivalents thereof are used herein to mean that other components, ingredients, steps, among others, may be optionally present. For example, an implementation "comprising" (or "which comprises") components A, B and C can consist of (i.e., contain only) components A, B and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose limit is the second number. For example, 25 to 100 mm means a range whose lower limit is 25 mm and upper limit is 100 mm.

Many suitable methods and corresponding materials to make each of the individual parts of implementation apparatus are known in the art. One or more implementation part may be formed by machining, 3D printing (also known as "additive" manufacturing), CNC machined parts (also known as "subtractive" manufacturing), and injection molding, as will be apparent to a person of ordinary skill in the art. Metals, wood, thermoplastic and thermosetting polymers, resins and elastomers as may be described hereinabove may be used. Many suitable materials are known and available and can be selected and mixed depending on desired strength and flexibility, preferred manufacturing method and particular use, as will be apparent to a person of ordinary skill in the art.

Any element in a claim herein that does not explicitly state "means for" performing a specified function, or "step for" performing a specific function, is not to be interpreted as a "means" or "step" clause as specified in 35 U.S.C. § 112(f). Specifically, any use of "step of" in the claims herein is not intended to invoke the provisions of 35 U.S.C. § 112(f). Elements recited in means-plus-function format are intended to be construed in accordance with 35 U.S.C. § 112(f).

Recitation in a claim of the term "first" with respect to a feature or element does not necessarily imply the existence of a second or additional such feature or element.

The phrases "connected to," "coupled to" and "in communication with" refer to any form of interaction between two or more entities, including mechanical, electrical, magnetic, electromagnetic, fluid, and thermal interaction. Two components may be functionally coupled to each other even though they are not in direct contact with each other. The terms "abutting" or "in mechanical union" refer to items that are in direct physical contact with each other, although the items may not necessarily be attached together.

The word "exemplary" is used herein to mean "serving as an example, instance, or illustration." Any implementation described herein as "exemplary" is not necessarily to be construed as preferred over other implementations. While various aspects of the disclosure are presented with reference to drawings, the drawings are not necessarily drawn to scale unless specifically indicated.

Reference throughout this specification to "an implementation" or "the implementation" means that a particular feature, structure, or characteristic described in connection with that implementation is included in at least one implementation. Thus, the quoted phrases, or variations thereof, as recited throughout this specification are not necessarily all referring to the same implementation.

Similarly, it should be appreciated that in the above description, various features are sometimes grouped together in a single implementation, Figure, or description thereof for the purpose of streamlining the disclosure. This method of disclosure, however, is not to be interpreted as reflecting an intention that any claim in this or any application claiming priority to this application require more features than those expressly recited in that claim. Rather, as the following claims reflect, inventive aspects may lie in a combination of fewer than all features of any single foregoing disclosed implementation. Thus, the claims following this Detailed Description are hereby expressly incorporated into this Detailed Description, with each claim standing on its own as a separate implementation. This disclosure is intended to be interpreted as including all permutations of the independent claims with their dependent claims.

What is claimed is:

1. A method comprising:

inserting a plurality of magnets into an article of manufacture, wherein the article of manufacture comprises at least one pouch comprising waterproof material and configured to retain at least one magnet of the plurality of magnets;

aligning north and south poles of each magnet of the plurality of magnets inserted into the article of manufacture with a north-south orientation of the article of manufacture; and configuring the at least one pouch to maintain alignment of each magnet of the plurality of magnets with the north-south orientation of the article of manufacture.

2. The method of claim 1, wherein at least one magnet of the plurality of magnets is a rare earth magnet.

3. The method of claim 2, wherein the rare earth magnet comprises neodymium.

4. The method of claim 1, wherein at least one magnet of the plurality of magnets has a magnetic field strength of at least 0.5 Tesla.

5. The method of claim 1, wherein at least one magnet of the plurality of magnets has a magnetic field strength of from 0.5 Tesla to 2 Tesla.

6. The method of claim 1, wherein the at least one pouch is subdivided into a grid of individual cells and each cell is configured to retain at least one magnet of the plurality of magnets.

7. The method of claim 6, wherein each cell is configured to maintain the alignment of each magnet of the plurality of magnets with the north-south orientation of the article of manufacture.

8. The method of claim 1, wherein aligning north and south poles of each magnet of the plurality of magnets further comprises adjusting the alignment of the plurality of magnets while observing magnetic field lines rendered by the plurality of magnets in the article of manufacture using iron filings disposed on a paper sheet.

9. The method of claim 1, wherein aligning north and south poles of each magnet of the plurality of magnets further comprises adjusting the alignment of the plurality of magnets while analyzing magnetic field lines of the plurality of magnets in the article of manufacture, using a magnetometer.

10. The method of claim 1, wherein the article of manufacture is a swimsuit.

11. The method of claim 1, wherein the plurality of magnets is inserted into a lining of the article of manufacture.

12. The method of claim 10, wherein the swimsuit has a top, a bottom, a front, and a back.

13. The method of claim 12, wherein the method further comprises disbursing the plurality of magnets throughout the front and back of the swimsuit.

14. The method of claim 1, wherein the method further comprises configuring the at least one pouch with at least one translucent section configured to permit a user to see a portion of a magnet while the magnet is retained by the at least one pouch.

15. The method of claim 1, wherein the method further comprises configuring at least one magnet of the plurality of magnets with a marking identifying a pole of the at least one magnet.

16. The method of claim 15, wherein the marking has a color selected from the group consisting of Red, Green, Blue, Yellow, Orange and White.

17. The method of claim 1, wherein the method further comprises installing and aligning a plurality of magnets in a plurality of pouches based on aligning markings identifying like poles of the plurality of magnets while viewing the markings through a plurality of translucent sections disposed in the plurality of pouches.

18. The method of claim 17, wherein the like poles are north poles.

19. The method of claim 17, wherein the like poles are south poles.

* * * * *